US009396865B1

(12) United States Patent
Folker et al.

(10) Patent No.: US 9,396,865 B1
(45) Date of Patent: Jul. 19, 2016

(54) MAGNETIC COMPONENT WITH AUXILIARY WINDING CIRCUIT BOARD

(71) Applicant: Universal Lighting Technologies, Inc., Madison, AL (US)

(72) Inventors: Donald Folker, Madison, AL (US); Mike LeBlanc, Huntsville, AL (US); David Blevins, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 14/074,498

(22) Filed: Nov. 7, 2013

(51) Int. Cl.
*H01F 27/30* (2006.01)
*H01F 27/28* (2006.01)
*H01F 27/29* (2006.01)

(52) U.S. Cl.
CPC ..... *H01F 27/2804* (2013.01); *H01F 27/29* (2013.01)

(58) Field of Classification Search
CPC ..... H01F 27/325; H01F 27/28; H01F 27/29; H01F 5/02
USPC ..... 336/198, 208, 192, 212, 232, 170, 214, 336/215
See application file for complete search history.

(56) References Cited

U.S. PATENT DOCUMENTS

| | | | | |
|---|---|---|---|---|
| 5,929,734 | A * | 7/1999 | Weiner | 336/61 |
| 7,498,921 | B1 * | 3/2009 | Wang | H01F 27/2852 336/200 |
| 2002/0057178 | A1 * | 5/2002 | Timashov et al. | 336/208 |
| 2004/0113739 | A1 * | 6/2004 | Du et al. | 336/200 |
| 2004/0257190 | A1 * | 12/2004 | Peck et al. | 336/212 |
| 2008/0297300 | A1 * | 12/2008 | Ackermann | H01F 27/2866 336/200 |
| 2010/0026437 | A1 * | 2/2010 | Lin | H01F 27/2847 336/192 |

* cited by examiner

*Primary Examiner* — Mangtin Lian
(74) *Attorney, Agent, or Firm* — Patterson Intellectual Property Law, P.C.; Mark J. Patterson; Gary L. Montle

(57) ABSTRACT

An auxiliary winding circuit board includes one or more auxiliary conductive windings. The auxiliary winding circuit board is positioned at an axial end of a bobbin, and a core leg extends through an opening in the auxiliary winding circuit board. A main conductive winding is positioned on the bobbin. The auxiliary winding disposed on the auxiliary printed circuit board has enhanced voltage-isolation from the main winding positioned on the bobbin, allowing both a high-voltage main winding and a low-voltage auxiliary winding to be located on one magnetic component. The magnetic component is configured for mounting on a printed circuit board for an electronic device such as a power supply. A modular magnetic component apparatus includes a bobbin with main winding assembly and multiple auxiliary winding circuit boards that may be interchangeably mounted between the bobbin and core for desired applications.

7 Claims, 3 Drawing Sheets

MAGNETIC COMPONENT WITH AUXILIARY WINDING CIRCUIT BOARD

BACKGROUND OF THE INVENTION

The present invention relates generally to magnetic component devices for electronic circuits, and more particularly to devices such as inductors and transformers for mounting on circuit boards.

Conventional magnetic devices such as inductors and transformers typically include one or more conductive windings positioned about a bobbin or other winding spool. The windings may include primary and secondary windings in a transformer, or may include one or more windings in an inductor. Magnetic devices of this nature in some applications include multiple windings, or coils, positioned around the bobbin. Each winding includes one or more turns of a conductive wire covered with insulation around the bobbin. Conventional circuits for electronic applications such as power supplies and power converters, as well as other electronic components, often include high-voltage circuit regions and low-voltage circuit regions. In many applications it is desirable to include one or more magnetic components associated with the high-voltage circuit region and to also include one or more magnetic components associated with the low-voltage circuit region.

However, because magnetic components are often the largest circuit items in an electronic device, cost considerations and layout efficiency make it desirable to combine the high-voltage and low-voltage windings on a single magnetic component in many applications. Others have attempted to overcome the cost and layout efficiency problems of conventional winding configurations by placing both low-voltage and high-voltage windings on a single bobbin structure on a magnetic component. However, voltage effects between the windings can cause undesirable performance such as noise, magnetic coupling and efficiency losses. Such conventional configurations provide little voltage isolation between the high-voltage and low-voltage windings because the windings are both positioned on the same bobbin in close proximity.

Another problem associated with multiple-winding magnetic components is winding placement. Conventional winding configurations that place main and auxiliary windings about a single bobbin structure include winding tolerances that may lead to inconsistent placement of the windings relative to each other and relative to the bobbin. This may lead to inconsistent magnetic coupling between the high-voltage main winding and the lower-voltage auxiliary windings, causing variance in performance between components. Additional problems with multiple windings on a single bobbin structure include high potential failures between windings, especially in high voltage applications. Such failures may lead to device malfunction and risk of fire.

To further overcome the problems with conventional winding configurations, others have developed low-profile magnetic devices that use planar windings disposed on a printed circuit board. Conventional printed winding board circuits include one or more winding loops formed as conductive traces on a printed circuit board. Multiple boards may be stacked and electrically connected to form multi-loop magnetic devices. However, conventional printed winding boards for magnetic devices are limited in the number of loops or turns that may be printed on the winding board substrate. For this reason, conventional printed winding boards are generally limited to relatively low-voltage applications as compared to bobbin-wound magnetic components used for higher-voltage applications.

What is needed then are improvements in magnetic component devices, wiring configurations, and associated methods for positioning high-voltage and low-voltage windings on a single magnetic component device.

BRIEF SUMMARY

The present invention provides a magnetic component apparatus having an auxiliary winding circuit board, or daughter card, with one or more auxiliary windings. The auxiliary winding circuit board is placed on the magnetic component apparatus between a core and a bobbin. The bobbin includes a main winding.

The auxiliary printed circuit board in some embodiments includes an opening aligned with an axial bobbin passage such that a core leg extends through the opening and into the bobbin passage. One or more windings on the auxiliary winding circuit board are positioned at least partially around the opening such that the windings are located around the core leg when the core leg is located in the bobbin passage.

In some embodiments, the auxiliary winding circuit board is substantially flat and is configured to rest against an axial end flange of the bobbin between the bobbin and the core. The auxiliary winding circuit board in some embodiments includes an electrical connector such as an auxiliary pin rail or a plug including auxiliary terminal pins connected to the one or more auxiliary windings. The connector interfaces with a corresponding feature on a main printed circuit board for electrically connecting the auxiliary winding circuit board to the main printed circuit board.

In a further embodiment, the magnetic component apparatus includes a bobbin defining an axial passage and a main winding positioned on the bobbin. A core includes a core leg shaped to fit at least partially into the axial passage. An auxiliary winding circuit board is positioned between the core and the bobbin. The auxiliary winding circuit board includes an opening shaped to accommodate the core leg through the opening when the core leg is fit at least partially in the axial passage. An auxiliary winding is disposed on the auxiliary winding circuit board, and the auxiliary winding is positioned around the opening.

A further embodiment of the present invention includes a magnetic component apparatus having a bobbin, a core, and an auxiliary winding circuit board positioned between the bobbin and the core. An opening is defined in the auxiliary winding circuit board. A first auxiliary winding is disposed on the auxiliary winding circuit board around the opening.

Yet another embodiment of the present invention provides a modular magnetic component apparatus including a core, a bobbin, and a main winding disposed on the bobbin. A first auxiliary winding circuit board is mountable between the bobbin and the core. The first auxiliary winding circuit board has a first auxiliary winding with a first number of turns. A second auxiliary winding circuit board is also mountable between the bobbin and the core. The second auxiliary winding circuit board has a second auxiliary winding with a second number of turns. The first number of turns and the second number of turns are not equal. The first and second auxiliary winding circuit boards are selectively interchangeable between the core and the bobbin such that either the first or the second auxiliary winding circuit board may be mounted between the core and the bobbin.

In additional embodiments, both the first and the second auxiliary winding circuit boards are installed between the bobbin and the core such that the core leg extends through openings in both the auxiliary winding circuit boards.

Another object of the present invention is to provide a magnetic component with a main winding positioned around a bobbin for use with a high-voltage circuit and one or more auxiliary windings positioned on an auxiliary winding circuit board adjacent the bobbin for use with one or more low-voltage circuits.

A further object of the present invention is to provide a magnetic component with main and auxiliary windings on one component to reduce the overall size of the component.

An additional object of the present invention is to provide a magnetic component with main and auxiliary windings where only the main winding needs to be wound on the bobbin, reducing winding time and reducing cost.

A further object of the present invention is to provide a magnetic component with physical separation between the high-voltage main winding and the low-voltage auxiliary windings to reduce the likelihood of high potential failures.

Yet another object of the present invention is to provide a magnetic component with improved voltage isolation between a main winding located on the bobbin and one or more auxiliary windings located on the auxiliary winding circuit board.

Additional objects of the present are to provide a magnetic component apparatus with a bobbin having a main winding that is configured to receive one or more interchangeable auxiliary winding circuit boards having different auxiliary winding configurations.

Another object of the present invention is to provide a magnetic component with both main and auxiliary windings and with only the main winding located on the bobbin for improving heat transfer away from the bobbin using a thermal compound between the main winding and a surrounding enclosure.

A further object of the present invention is to provide a modular bobbin and auxiliary winding circuit board system with numerous auxiliary winding circuit boards each having a different winding configuration, wherein each auxiliary winding circuit board is interchangeable with a common bobbin and main winding assembly.

Numerous other objects, advantages and features of the present invention will be readily apparent to those of skill in the art upon a review of the following drawings and description of a preferred embodiment.

DETAILED DESCRIPTION

Figure 1:
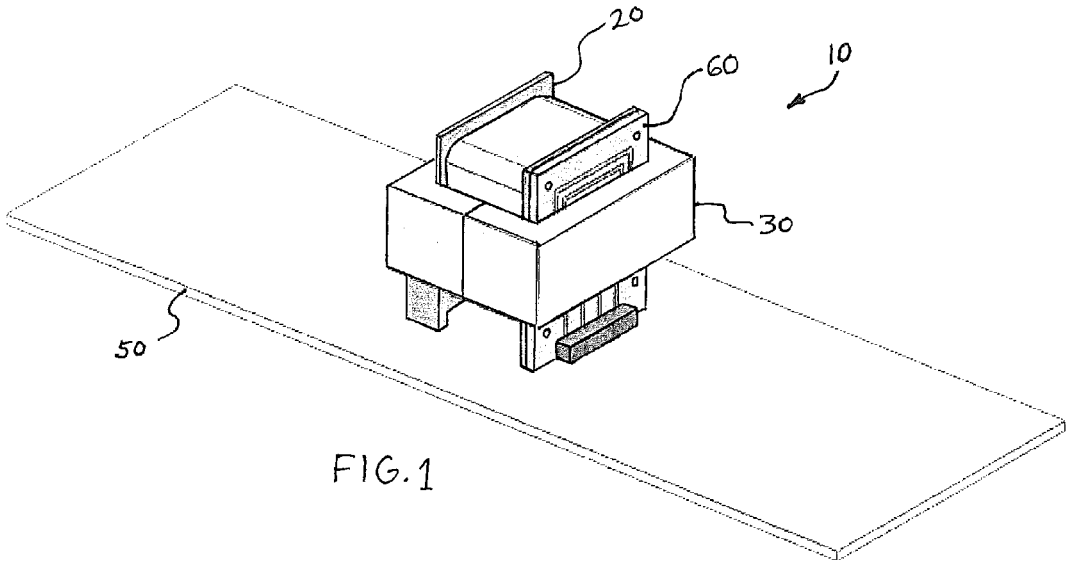
FIG. 1 illustrates a perspective view of an embodiment of a magnetic component including an auxiliary winding circuit board.

Referring now to the drawings, FIG. 1 illustrates an embodiment of a magnetic component apparatus 10 installed on a main printed circuit board 50. Magnetic component 10 may be a transformer and/or inductor in various embodiments. Magnetic component 10 generally includes a bobbin 20 and a magnetically permeable core 30. Core 30 in some embodiments is an E-core. Magnetic component 10 is generally installed on a main printed circuit board 50 having one or more circuits disposed thereon. In many applications, main printed circuit board 50 includes a circuit for a power supply or power converter device such as a lighting control, lighting ballast, AC/DC converter, or DC/DC converter. Magnetic component 10 is typically just one of several electronic components mounted on printed circuit board 50 in some embodiments. Other electronic components on main printed circuit board 50 may include resistors, capacitors, amplifiers, diodes, integrated circuits, transistors, and other components.

Figure 2:
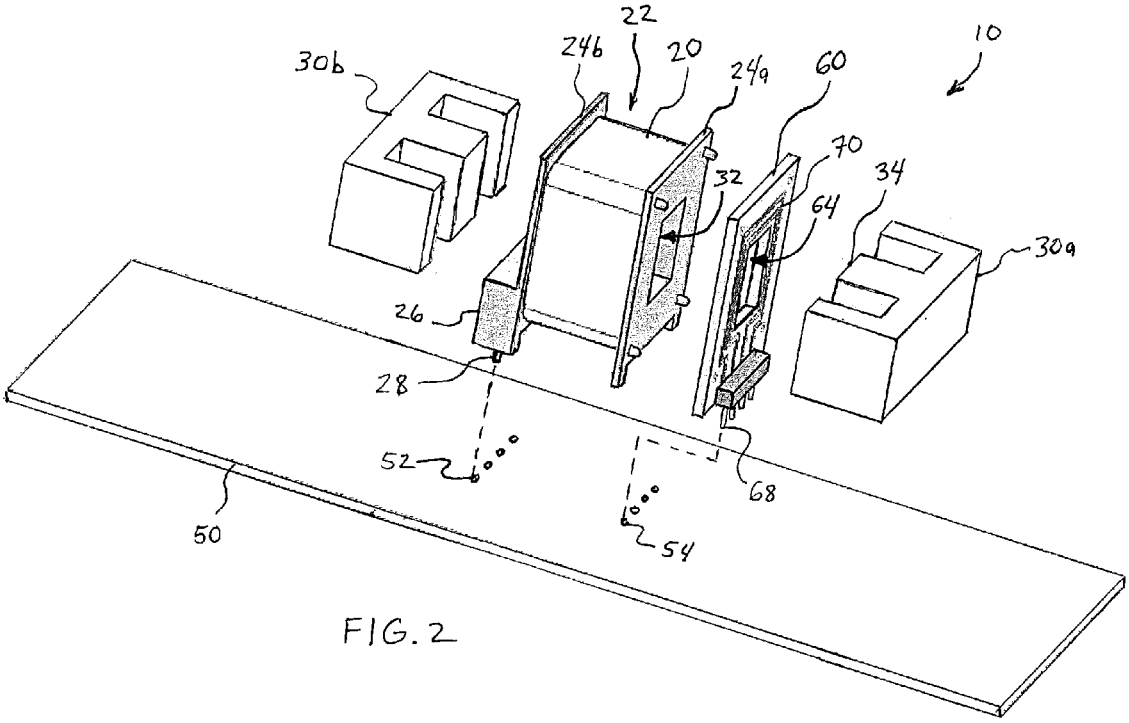
FIG. 2 illustrates an exploded perspective view of the embodiment of a magnetic component including an auxiliary winding circuit board of FIG. 1.
Figure 3:
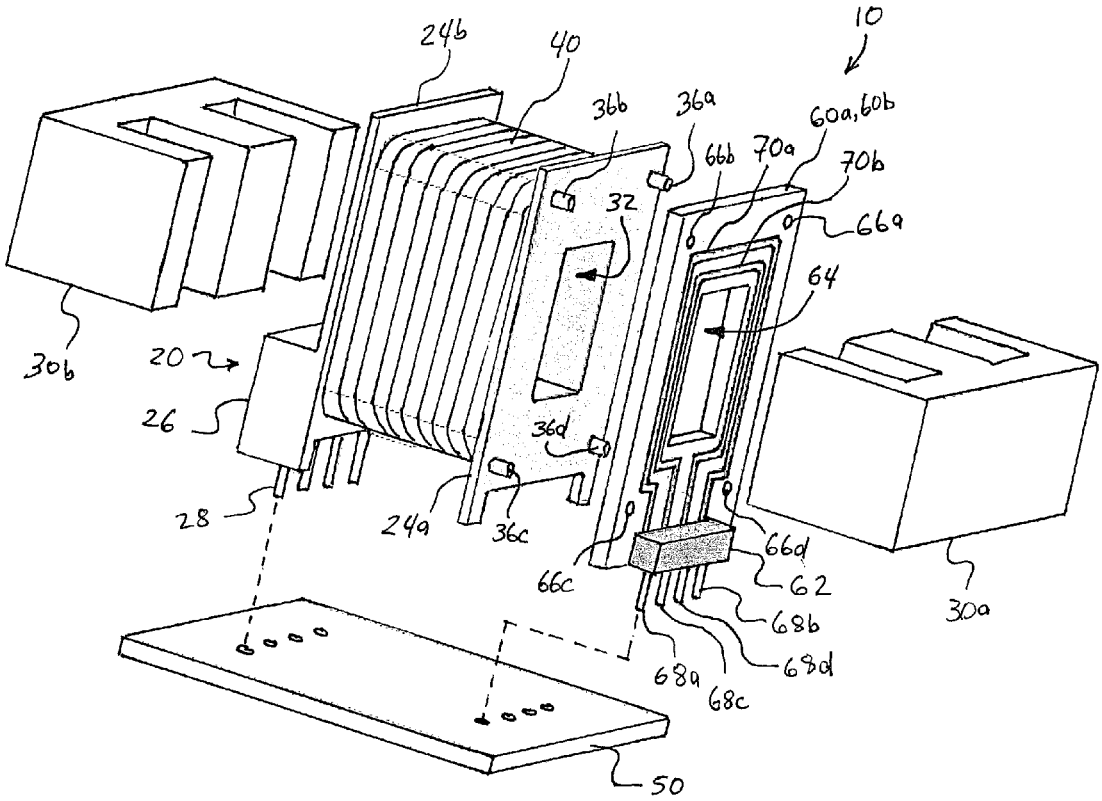
FIG. 3 illustrates a detail exploded perspective view of an embodiment of a magnetic component including an auxiliary winding circuit board.
Figure 4:
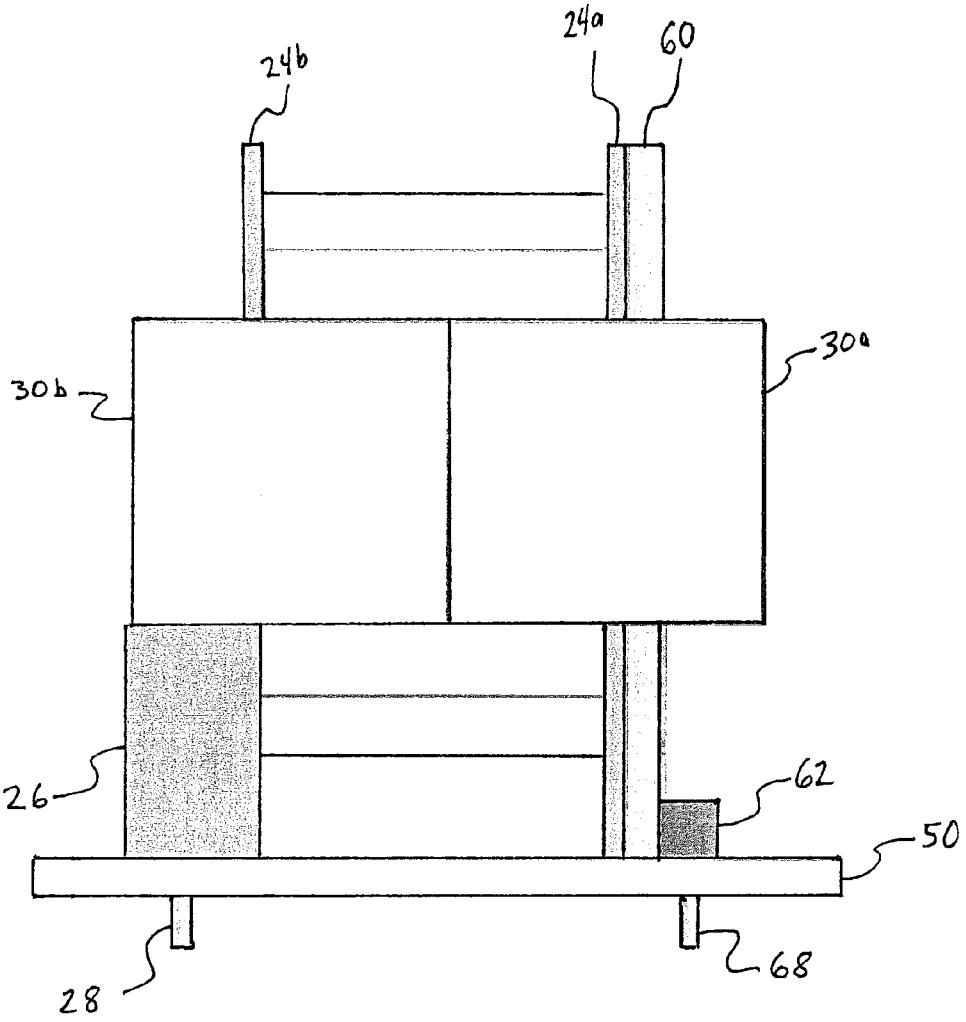
FIG. 4 illustrates a side elevation view of an embodiment of a magnetic component including an auxiliary winding circuit board.

Referring to FIGS. 2 and 3, bobbin 20 includes a central winding region 22 about which one or more conductive main windings 40, or coils, may be located. Each conductive main winding 40 includes one or more turns of conductive wire around the bobbin 20 in the winding region 22. As seen in FIG. 2, in some embodiments, bobbin 20 also has an axial passage 32 extending through the bobbin. Axial passage 32 is shaped to receive one or more core legs 34 extending from the core 30. In some embodiments, core 30 includes a first core half 30*a* and a second core half 30*b*. Axial passage 32 in bobbin 20 is shaped to receive a portion of a leg from one or both core halves in some embodiments. Axial passage 32 may be formed in various suitable cross-sectional shapes generally dimensioned to correspond to the shape of the core legs inserted in the passage. For example, in some embodiments, axial passage 20 may be rectangular, circular, oval, square, triangular, or other suitable shape to receive one or more corresponding core legs having similar shapes.

A main winding 40 is disposed on bobbin 20. Main winding 40 may be formed of an electrically conductive material such as a conductive wire. Main winding 40 includes multiple loops of the wire wound around the bobbin winding region 22. Main winding 40 is generally configured to be connected to a circuit or circuit region on main circuit board 50. Main winding 40 can include a winding for an inductor or a transformer in some embodiments. Main winding 40 is connected to one or more bobbin terminal pins 28 protruding from bobbin 20. In some embodiments, a bobbin pin rail 26 is located on bobbin 20 at a position to engage circuit board 50, and multiple bobbin terminal pins 28 protrude from bobbin pin rail 26. Each bobbin terminal pin 28 may be inserted through a corresponding bobbin terminal pin via 52 (FIG. 2) located on main circuit board 50 for providing an electrical connection between a circuit on main circuit board 50 and the main winding 40. In some embodiments, main winding 40 is a winding for a high-voltage circuit or high-voltage circuit region disposed on main circuit board 50. Alternatively, in some embodiments, multiple main windings may be located in the winding region 22 on bobbin 20. Main winding 40 may also be used for lower-voltage applications.

An auxiliary winding circuit board 60 is positioned between the bobbin 20 and core 30 in some embodiments. One or more auxiliary windings 70 are located on auxiliary winding circuit board 60. Auxiliary winding circuit board 60 is provided to include additional windings on the magnetic component that are separated from the winding region 22 on bobbin 20. Auxiliary winding circuit board 60 generally may be a printed circuit board or printed winding board having one or more auxiliary windings 70 printed thereon. Auxiliary winding circuit board 60 generally has a small thickness compared to the axial dimension of bobbin 20. Auxiliary winding circuit board 20 is installed between an axial end of bobbin 20 and core 30 such that the addition of the auxiliary winding circuit board 60 does not greatly increase the profile of the magnetic component. Auxiliary winding circuit board 60 can be a single-sided, double-sided, or multi-layer printed circuit board in various embodiments.

An opening 64 is defined in auxiliary winding circuit board 60. Opening 64 may be a void shaped to allow passage of a core leg 34 on core 30. Opening 64 is shaped to accommodate core leg 34 through the opening 64 when the core leg 34 is installed in axial passage 32 on bobbin 20. As such, core leg 34 may be inserted through both opening 64 and axial passage 32. In some embodiments, opening 64 has a cross-sectional profile shaped to match the cross-sectional profile of axial passage 32. For example, opening 64 and axial passage 32 both have a rectangular cross-sectional profile, as seen in FIG. 3. In other embodiments, opening 64 may have other suitable profiles such as circular, square, oval, or other polygonal or curvilinear shapes. Opening 64 also has the same dimensions as the interior of bobbin passage 32 in some embodiments. This allows a core leg 64 to be inserted through opening 64 and into axial passage 32.

Auxiliary winding circuit board 60 includes one or more auxiliary windings 70. Each auxiliary winding 70 is formed from an electrically conductive material such as a copper trace. Each auxiliary winding 70 may be printed on the auxiliary winding circuit board 60 or may include any other suitable electrical conductor disposed on the auxiliary winding circuit board 60. Auxiliary winding 70 is positioned to form at least a partial loop around opening 64. Auxiliary winding 70 need not extend completely 360 degrees around opening 64 to be located around opening 64. For example, as seen in FIG. 3, a first auxiliary winding 70*a* extends around three sides of opening 64, forming a U-shaped single-turn winding on auxiliary winding circuit board 60 around opening 64.

One or more auxiliary terminal pins 68 protrude from auxiliary winding circuit board 60 for connection to a main circuit board 50. Each auxiliary terminal pin 68 is located to be inserted in a corresponding auxiliary terminal pin via 54 located on main printed circuit board 50 in some embodiments. An auxiliary pin rail 62 (FIG. 3) is located on auxiliary winding circuit board 60, and each auxiliary terminal pin 68 protrudes from the auxiliary pin rail 62 in some embodiments. In other embodiments, any suitable electrical connector or plug may be used on auxiliary winding circuit board 60 to interface with and provide an electrical connection to a corresponding connector, vias or plug on main circuit board 50.

Auxiliary winding circuit board 60 includes only one auxiliary winding 70 in some embodiments. Auxiliary winding 70 may be a single-turn winding or a multiple-turn winding. Alternatively, auxiliary winding circuit board 60 includes multiple auxiliary windings. For example, in some embodiments, a first auxiliary winding 70*a* and a second auxiliary winding 70*b* are located on auxiliary winding circuit board 60, as seen in FIG. 3. First auxiliary winding 70*a* forms a first single-turn winding around opening 64, and second auxiliary winding 70*b* forms a second single-turn winding around opening 64. First auxiliary winding 70*a* is connected at a first end to first auxiliary terminal pin 68*a* and at the other end to second auxiliary terminal pin 68*b*. Second auxiliary winding 70*b* is connected at a first end to third auxiliary terminal pin 68*c* and at the other end to fourth auxiliary terminal pin 68*d*. The auxiliary terminal pins 68 protrude from auxiliary pin rail 62 for connection to main printed circuit board 50. During use, low-voltage magnetic coupling may be achieved between first and second auxiliary windings 70*a*, 70*b* in some applications.

Bobbin 20 includes first and second bobbin end flanges 24*a*, 24*b* in some embodiments. Winding region 22 is located between the first and second bobbin end flanges 24*a*, 24*b*. In some embodiments, auxiliary winding circuit board 60 is located adjacent one of the first and second bobbin end flanges 24*a*, 24*b*. Auxiliary winding circuit board 60 is shaped to have the same outer profile its nearest bobbin end flange in some embodiments. One or more fasteners 36 are located on one of the bobbin end flanges adjacent the auxiliary winding circuit board 60 for securing the auxiliary winding circuit board 60 to the bobbin 20. In some embodiments, as seen in FIG. 3, first, second, third and fourth posts 36*a*, 36*b*, 36*c*, 36*d* protrude from one bobbin end flange. The posts engage corresponding first, second, third and fourth sockets 66*a*, 66*b*, 66*c*, 66*d* defined in auxiliary winding circuit board 60. Each post engages a corresponding socket in an interference fit in some embodiments. This allows auxiliary printed circuit board 60 to be easily installed on bobbin 20 by simply pressing the posts in corresponding sockets. In additional embodiments one or more fasteners such as posts 36 protrude from each axial end of bobbin 20, and a separate auxiliary winding circuit board may be positioned on each axial end of bobbin 20. Any other suitable fastener configuration may be used to secure auxiliary winding circuit board 60 to bobbin 20, such as but not limited to screws, clips, adhesives, soldering or other mechanical connectors. Additionally, in some embodiments, auxiliary winding circuit board 60 may be held in place without any fastener simply by being sandwiched between bobbin 20 and core 30. In some embodiments, one or more additional layers may be positioned between bobbin 20 and auxiliary winding circuit board 20. Such layers may include thin film layers, thermal insulating layers, dielectric layers, noise-reducing layers, RF shielding layers, or any other suitable layers for electronic applications.

In some embodiments, main winding 40 is associated with a first circuit or circuit region on main printed circuit board 50, and one or more auxiliary windings 70 are associated with a second circuit or circuit region on main printed circuit board 50. The first circuit or circuit region may be associated with a higher voltage than the second circuit or circuit region. By positioning the one or more auxiliary windings 70 on an auxiliary winding circuit board 60 outside of winding region 22 on bobbin 20, the auxiliary windings 70 may experience improved voltage isolation from the main winding 40.

Another aspect of the present invention provides a magnetic component apparatus 10 including a bobbin 20 having a main winding 40 forming a bobbin and main winding assembly. The bobbin and main winding assembly is configured to receive interchangeable auxiliary winding circuit boards 60*a*, 60*b* (FIG. 3). For example, a first auxiliary winding circuit board 60*a* having a first auxiliary winding configuration may be used with the bobbin and main winding assembly for a first circuit application. However, for a second circuit application, a different auxiliary winding configuration is needed. Because the bobbin and main winding assembly in this embodiment is configured to receive interchangeable auxiliary winding circuit boards, the same bobbin and main winding assembly may also be used with a second auxiliary winding circuit board 60*b* having a different auxiliary winding configuration than the first auxiliary winding circuit board. This allows greater flexibility and reduces costs of manufacture in some applications, as a common bobbin and main winding assembly can be used for different circuit applications simply by selecting one or more different auxiliary winding circuit boards appropriate for the desired application.

In some additional embodiments, multiple auxiliary winding circuit boards may be disposed between the bobbin and the core. For example, first and second auxiliary winding circuit boards may be stacked between bobbin 20 and core 30.

Alternatively, more than two auxiliary winding circuit boards may be stacked between bobbin 20 and core 30. Each auxiliary winding circuit board can include a similar or dissimilar auxiliary winding configuration.

Another feature of the present invention provides the ability to replace only the auxiliary winding circuit board on a magnetic component in the event of failure. By forming the auxiliary windings on a removable auxiliary winding circuit board, the auxiliary winding circuit board can be removed from the magnetic component in the event of failure without disturbing the main winding on the bobbin in some embodiments.

The present invention also provides a method of manufacturing a magnetic component, including the steps of: (a) providing a bobbin with a main winding positioned around an axial passage; (b) providing an auxiliary winding circuit board with an opening and an auxiliary winding printed on the auxiliary winding circuit board; and (c) installing a core through the opening into the axial passage.

Thus, although there have been described particular embodiments of the present invention of new and useful Magnetic Component with Auxiliary Winding Circuit Board, it is not intended that such references be construed as limitations upon the scope of this invention except as set forth in the following claims.

What is claimed is:

1. A magnetic component apparatus, comprising:

a bobbin having a first end flange and a second end flange, and having an axial passage extending through the bobbin;

a core having at least a first main body portion and having at least one leg extending from the main body portion, the at least one leg positionable in the axial passage;

a main winding wound around the bobbin between the first end flange and the second end flange;

at least one substantially planar auxiliary winding circuit board having an opening, the auxiliary winding circuit board having a first auxiliary winding disposed at least partially around the opening, the auxiliary winding circuit board positioned between the first end flange of the bobbin and the at least a first main body portion of the core with the at least one leg of the core extending through the opening of the auxiliary winding circuit board;

an auxiliary terminal pin rail disposed on the auxiliary winding circuit board; and a first fastener component disposed on the bobbin and a second fastener component disposed on the auxiliary winding circuit board, the first fastener component selectively engageable with the second fastener component to removably mount the auxiliary winding circuit board to the bobbin.

2. The apparatus of claim 1, further comprising a second auxiliary winding disposed on the at least one auxiliary winding circuit board and extending at least partially around the opening.

3. The apparatus of claim 2, wherein each of the first auxiliary winding and the second auxiliary winding comprises a single-turn winding.

4. The apparatus of claim 1, wherein the first auxiliary winding is a single-turn winding.

5. The apparatus of claim 1, further comprising an auxiliary terminal pin connected to the auxiliary winding and protruding from the auxiliary pin rail.

6. The apparatus of claim 1, wherein:

the at least one auxiliary winding circuit board is a first auxiliary winding circuit board; and the first auxiliary winding circuit board is removable from the first flange of the bobbin and is replaceable with a second auxiliary winding circuit board.

7. The apparatus of claim 1, wherein:

the first fastener component comprises at least one post on the first flange of the bobbin; and the second fastener component comprises at least one socket on the auxiliary winding circuit board, the at least one socket positioned and sized to engage the at least one post with an interference fit.

* * * * *